US005291163A

United States Patent [19]

Finkle et al.

[11] Patent Number: 5,291,163

[45] Date of Patent: Mar. 1, 1994

[54] YIG SPHERE POSITIONING APPARATUS

[75] Inventors: Thomas W. Finkle; Terry A. Jones, both of Santa Rosa, Calif.

[73] Assignee: Hewlett-Packard Company, Palo Alto, Calif.

[21] Appl. No.: 921,823

[22] Filed: Jul. 29, 1992

[51] Int. Cl.[5] ..... H01P 7/00

[52] U.S. Cl. ..... 333/219.2; 333/202; 333/235

[58] Field of Search ..... 333/219.2, 219, 235, 333/202; 324/95

[56] References Cited

U.S. PATENT DOCUMENTS

| | | | |
|---|---|---|---|
| 4,420,731 | 12/1983 | Schiebold et al. | 333/202 |
| 4,480,238 | 10/1984 | Iwasaki | 333/219.2 |
| 4,667,172 | 5/1987 | Longshore et al. | 333/202 |
| 4,675,630 | 6/1987 | Tang et al. | 333/235 |
| 4,857,871 | 8/1989 | Harris | 333/202 |

FOREIGN PATENT DOCUMENTS

| | | | |
|---|---|---|---|
| 0109714 | 5/1984 | France | 333/219.2 |
| 1566426 | 5/1990 | U.S.S.R. | 333/202 M |

*Primary Examiner*—Raymond A. Nelli

*Attorney, Agent, or Firm*—William C. Milks, III

[57] ABSTRACT

In a tunable ferrimagnetic resonator circuit, apparatus and method for tuning the circuit by manipulation of the position of the YIG spheres with respect to their associated coupling loops and the magnetic field. Each YIG sphere can be moved in three axial directions or rotated for alignment with the magnetic field while the circuit is under test, without the need for removal of any parts and without visual observation. Once the sphere has been positioned, it is automatically retained in that position without the need to be encapsulated in epoxy. The tuning process can be repeated or the circuit can be retuned at any time. The tuning apparatus can be coupled to external tooling which is manually manipulatable. Limits are included in the external tooling to prevent the spheres from touching other portions of the circuit.

13 Claims, 8 Drawing Sheets

YIG SPHERE POSITIONING APPARATUS

FIELD OF THE INVENTION

This invention relates generally to tunable ferrimagnetic resonator circuits, and more particularly to apparatus for tuning a YIG-tuned resonator filter and mixer by manipulation of the spheres.

BACKGROUND OF THE INVENTION

Tunable tracking ferrimagnetic resonator circuits are well known. One example of a ferrimagnetic resonator circuit is a YIG-tuned filter and mixer, as described in U.S. Pat. No. 4,817,200, assigned to the assignee of the present application.

YIG-tuned resonator circuits may include several YIG-tuned resonators connected in series. Each resonator comprises a yttrium-iron-garnet (YIG) sphere suspended between two orthogonal half loop conductors. An RF signal is applied to the input half loop conductor, causing an RF magnetic field in the region of the half loop. In the absence of the YIG sphere, the magnetic field is not coupled to the orthogonal output half loop conductor. The YIG material exhibits ferrimagnetic resonance. In the presence of an external DC magnetic field, the dipoles in the YIG sphere align with the magnetic field, producing a strong magnetization.

Performance of any YIG microcircuit may be optimized by manipulation of the YIG spheres, so that each resonator is tuned to the same frequency. The resonance frequencies should track over the frequency range of interest. The location of each sphere relative to its associated coupling loops, the proximity of the coupling loops to the ground plane, and the uniformity and orientation of the magnetic field all have an effect on the performance of such a microcircuit. Manipulation of these spheres may be accomplished either by tooling external to the microcircuit or by the internal design of the microcircuit. For some YIG microcircuits, where only two degrees of freedom are sufficient, a simple fixed collet arrangement may be used to control a sphere support rod. However, higher performance products require more optimal placement of the spheres, thus requiring greater control over the location of the spheres and therefore more degrees of freedom of movement of the spheres.

In one known design, the microcircuit utilizes four resonators connected in series, each of which includes a YIG sphere secured by a collet on a distal end of a non-magnetic, non-electrically conductive rod. The rod associated with each sphere passes through an O-ring seal in the side of a housing surrounding the circuit. Adjustment of the position of the sphere is accomplished through the use of external tooling which engages the collet on the rod within the housing. One set of tooling is used for adjustment in the X-Y plane, and another set of tooling is used for rotation or Z-axis adjustment. Only one set of tooling can be attached to the collet at any one time, and thus, adjustment in the X-Y plane and rotation or Z-axis adjustments cannot be done at the same time. The tooling is manipulated while watching the location of the sphere through a microscope. However, one drawback with this design is that since visual observation is necessary for proper placement of the sphere, one of the magnets typically must be removed for X-Y plane adjustments, and thus, tuning cannot be performed while the circuit is under test. As a result, the adjustment is an iterative process of testing, removing a magnet, manipulating the spheres, replacing the magnet, and then retesting.

In another known product in which YIG sphere translation is possible, the sphere rod collet is suspended from a housing wall by two O-ring seals. In this apparatus, external tooling is connected directly to the proximal end of the sphere rod, rather than to the collet, for manipulation of the YIG sphere. Movement of the YIG sphere in a direction generally parallel to the housing wall can be produced by pivoting of the sphere rod about the point at which it passes through the housing wall, while movement of the sphere generally perpendicular to the housing wall can be accomplished by pushing or pulling on the sphere rod. In each instance, movement of the sphere is produced by deformation of the O-ring seal. In this design, tuning can be performed while the circuit is under test, without removal of any magnet. Such tuning is accomplished by observing the frequency response of the circuit. While this apparatus eliminates any iterative adjustment process, the magnet must be removed prior to final positioning to apply an epoxy encapsulate to hold the spheres in alignment. The O-ring seals are not able to hold the spheres in alignment by themselves, because of residual stresses due to their resilience. After the magnet is replaced, final adjustments must be made to the system before the epoxy cures to correct for any disruption of the alignment caused by the encapsulation process and by the removal and replacement of the magnet.

In each of the foregoing apparatuses, great care and skill is required to tune the circuit, and the process is time-consuming. Moreover, the danger always exists of accidentally crashing the spheres into the coupling loops surrounding them, causing damage to the spheres or to other portions of the circuit.

It is therefore an object of the present invention to provide improved apparatus for rotation and for manipulation in three axes of the spheres in a ferrimagnetic microcircuit.

It is another object of the present invention to provide apparatus for manipulation of the spheres in a YIG microcircuit which allows tuning under test and which requires no epoxy encapsulate.

It is yet another object of the present invention to provide apparatus for manipulation of spheres in a YIG microcircuit which minimizes the possibility of the spheres contacting the coupling loops or other portions of the microcircuit.

It is yet another further object of the present invention to provide an improved method for tuning of a YIG microcircuit while under test.

It is yet another further object of the present invention to provide external tooling which permits manipulation of the spheres in a YIG microcircuit in a user-friendly manner while under test and which can be engaged or disengaged without disturbing the positions of the spheres.

SUMMARY OF THE INVENTION

These and other objects are achieved in accordance with the present invention which relates to a ferrimagnetic resonator microcircuit, such as a YIG-tuned resonator filter and mixer, which includes ferrimagnetic spheres, each of which can be independently manipulated using external controls while the circuit is under test. Each sphere is mounted on a distal end of a rod which extends through and is suspended from a support disposed within a housing enclosing the circuit. Apparatus connectable to external tooling permits the support to be adjusted in one direction for movement of the sphere along one axis, and adjusted in another direction for a movement of the sphere along an axis roughly perpendicular to the first axis. The rod itself can be advanced or retracted through the support, thereby permitting movement of the sphere along a third axis perpendicular to the first two axes. Finally, the rod can be rotated about an axis parallel to its direction of elongation, thus permitting rotation of the sphere.

In a preferred embodiment, the support is rotated about a projection by the use of an eccentric cam which produces movement of the sphere along one axis. The cam is rotated by a shaft or screw which is connectable to external tooling. Another adjusting screw is used to bend the support carrying the sphere rod about an axis passing through the support to produce movement of the sphere along the second axis. This adjusting screw is connectable to external tooling as well. A flexible attachment is secured to the proximal end of the sphere rod, allowing movement of the sphere rod along the third axis and permitting rotation thereof.

In another aspect of the invention, external tooling is provided for manipulation of the spheres. A torsionally rigid tube is removably coupled to each adjusting screw at one end externally of the housing and is coupled to a knob for manipulation by the user at the other end. Associated with each knob is a stop which limits the permissible range of movement for that particular adjusting screw to a predetermined amount. A clutch provides an override to allow additional adjustment should the user determine that it is necessary. The flexible attachment to the proximal end of the sphere rod is accessible externally of the housing for the microcircuit and is provided with knobs for rotation of the sphere rod or for axial movement thereof.

According to yet another aspect of the invention, a method is provided for tuning of the ferrimagnetic resonator microcircuit. Each sphere is tuned sequentially under test by movement of the sphere along selected ones of three axes and by rotation thereof. Tuning is accomplished by observing the frequency response signal while manually manipulating the external tooling. Once the spheres have been adjusted, they are held in position by the apparatus without the need of epoxy encapsulation. The tooling is then disconnected, and the circuit is ready for use. This tuning process can be repeated or resumed as is necessary.

Since the external tooling can be attached without disturbing the microcircuit, tuning thereof can be accomplished while under test conditions. Moreover, since the position of each sphere, once it has been adjusted, is locked into place by the components of the apparatus, it is unnecessary to encapsulate any portion of the circuit. Once the circuit has been tuned, no further adjustments are necessary. As a consequence, the tuning process is relatively fast, efficient, and is highly accurate. Moreover, tuning can be repeated at any time and as many times as is necessary.

BRIEF DESCRIPTION OF THE DRAWINGS

The objects, advantages, and features of this invention will be more clearly appreciated from the following detailed description when taken in conjunction with the accompanying drawings in which.

DETAILED DESCRIPTION OF THE PREFERRED EMBODIMENTS

Figure 1:
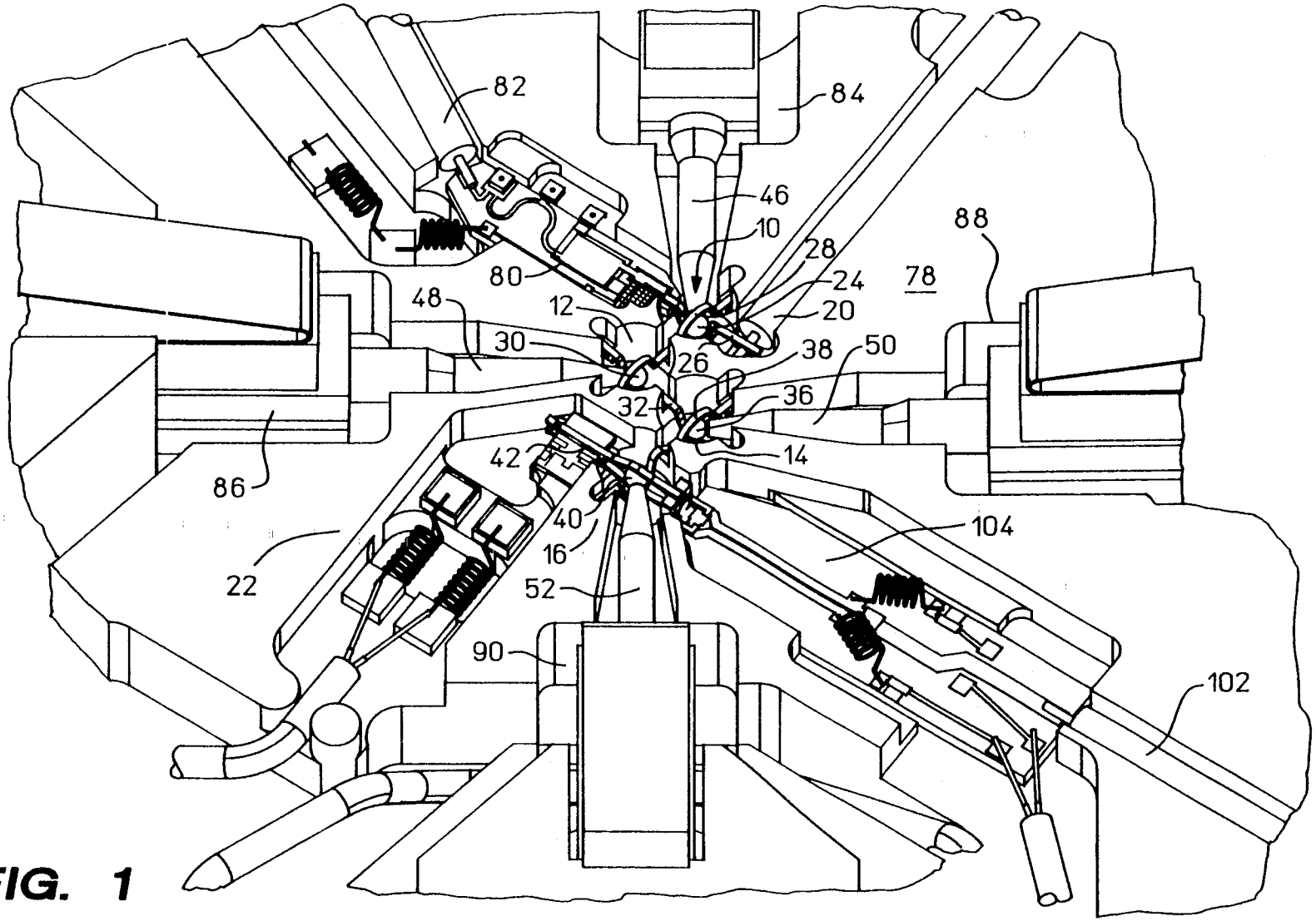
FIG. 1 is a perspective view of a typical YIG-tuned resonator circuit with which the apparatus of this invention is used.
Figure 2:
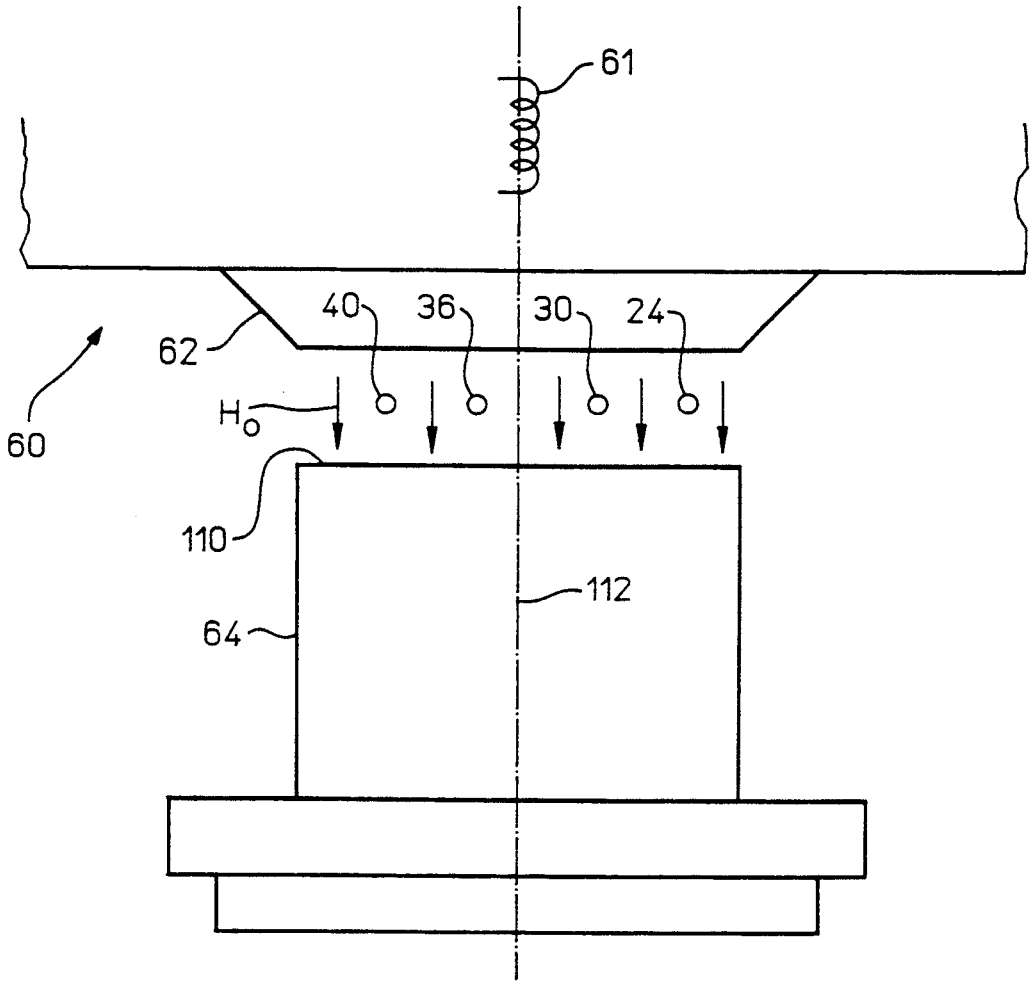
FIG. 2 is a simplified elevational view of a YIG-tuned resonator circuit with which this invention is used.

With reference now to the drawings, and more particularly to FIGS. 1 and 2 thereof, a typical tunable, ferrimagnetic resonator microcircuit will now be described with which the positioning apparatus and method of the present invention may be used. However, it is to be understood that the positioning apparatus of this invention may be used in conjunction with other similar resonator circuits, and its use is not limited to the particular circuit described herein.

FIG. 1 is a simplified perspective view of a typical YIG-tuned resonator circuit with which the apparatus of this invention may be used, while FIG. 2 is a simplified elevational view of the YIG-tuned resonator circuit of FIG. 1. A typical YIG-tuned resonator filter and mixer includes an input resonator 10, an intermediate resonator 12, an intermediate resonator 14, and an output resonator 16. It is to be understood that the number of intermediate resonators can be greater or fewer than two, depending on the particular filter design. The resonators 10, 12, 14, and 16 are connected in series between an input coax 20 and an output 22. Input resonator 10 includes a ferrimagnetic sphere 24, such as a YIG sphere, mounted between an input coupling loop 26 and a coupling loop 28. Resonator 12 includes a ferrimagnetic sphere 30, such as a YIG sphere, mounted between coupling loop 28 and a coupling loop 32. Resonator 14 includes a ferrimagnetic sphere 36, such as a YIG sphere, mounted between coupling loop 32 and a coupling loop 38. Output resonator 16 includes a ferrimagnetic sphere 40, such as a YIG sphere, mounted between coupling loop 38 and an output coupling loop 42.

Each of the coupling loops 26, 28, 32, 38, and 42 is conductive. The input coupling loop 26 comprises a half loop connected to coax 20. The output coupling loop 42 comprises an element of an image-enhanced harmonic mixer. Coupling loops 28, 32, and 38 each comprise a double half loop for interconnecting successive resonators. Coupling loops in each resonator are preferably orthogonal but can deviate from orthogonal by up to about ten degrees without significant degradation in performance. The coupling loops 26, 28, 32, 38, and 42 alternate in direction to form a zigzag pattern. The YIG spheres 24, 30, 36, and 40 are carried at the distal end of support members or rods 46, 48, 50, and 52 which are both electrically insulating and non-magnetic.

As shown in FIG. 2, a DC magnetic field $H_0$ is applied to the resonators 10, 12, 14, and 16 (represented in FIG. 2 by spheres 24, 30, 36, and 40, respectively). The magnetic field $H_0$ is generated by an electromagnet 60. The resonators 10, 12, 14, and 16 are positioned between pole pieces 62 and 64 in a plane generally perpendicular to the direction of magnetic field $H_0$. By varying the magnitude of magnetic field $H_0$ by controlling the current to a coil 61 of the electromagnet 60, the resonance frequency of resonators 10, 12, 14, and 16 is tuned over a desired frequency range.

In a preferred embodiment, the YIG spheres 24, 30, 36, and 40 have diameters of about 0.3 millimeters, and the radius of each of the coupling loops 26, 28, 32, 38, and 42 is about 0.4 millimeters. The support rods 46, 48, 50, and 52 are preferably formed of aluminum oxide. The ends of coupling loops 28, 32, and 38 are connected to ground.

In operation, an input RF signal received on coax 20 causes an RF current to flow through coupling loop 26. The RF current produces a magnetic field in the vicinity of YIG sphere 24. In the absence of YIG sphere 24, the magnetic field is not coupled to orthogonal coupling loop 28. However, when the applied magnetic field $H_0$ causes YIG sphere 24 to have a resonance frequency that is the same or nearly the same as the frequency of the input RF signal, the precession of magnetic dipoles in the YIG sphere 24 causes the RF magnetic field to be coupled to coupling loop 28. Thus, the resonator 10 passes RF signals having the same or nearly the same frequency as the resonance frequency of YIG sphere 24. Resonators 12, 14, and 16 operate in the same manner to provide a highly-selective RF filter. By varying the magnetic field $H_0$ by controlling the current to a coil 61 of the electromagnet 60, the pass band of the filter is tuned over a broad frequency range.

The YIG-tuned resonator circuit is mounted in a conductive chassis 78 typically fabricated of an alloy of copper and nickel. The chassis 78 is provided with openings for mounting resonators 10, 12, 14, and 16 and associated circuitry. One end of input coupling loop 26 is connected to an input switch assembly 80 which couples input signals in a frequency range of DC to 3 GHz to a low-frequency processing section through a coax 82.

YIG sphere support rods 46, 48, 50, and 52 are mounted onto sphere-positioning assemblies 84, 86, 88, and 90, respectively. The sphere-positioning assemblies permit adjustment of the respective sphere positions in three axial directions and rotation of the respective YIG spheres. The sphere-positioning assemblies ensure that each YIG sphere is optimally positioned with respect to the input and output coupling loops. In addition, the sphere-positioning assemblies permit the YIG spheres to be rotated so that the crystalline axis of each YIG sphere has a desired orientation with respect to the external DC magnetic field. These adjustments permit a desired frequency response to be obtained.

The YIG-tuned resonator circuit, including a technique for adjusting tracking of the YIG-tuned resonator filter and mixer, is described in greater detail in a co-pending application entitled YIG-TUNED CIRCUIT WITH ROTATABLE MAGNETIC POLE PIECE, filed in the name of Hassan Tanbakuchi concurrently herewith, the disclosure of which is hereby incorporated by reference.

In the embodiment of FIG. 1, output resonator 16 comprises an element of an image-enhanced harmonic mixer. The image-enhanced mixer is described in detail in a co-pending application entitled SWITCHED YIG-TUNED HARMONIC MIXER, filed in the name of Hassan Tanbakuchi concurrently herewith, the disclosure of which is hereby incorporated by reference.

Figure 3:
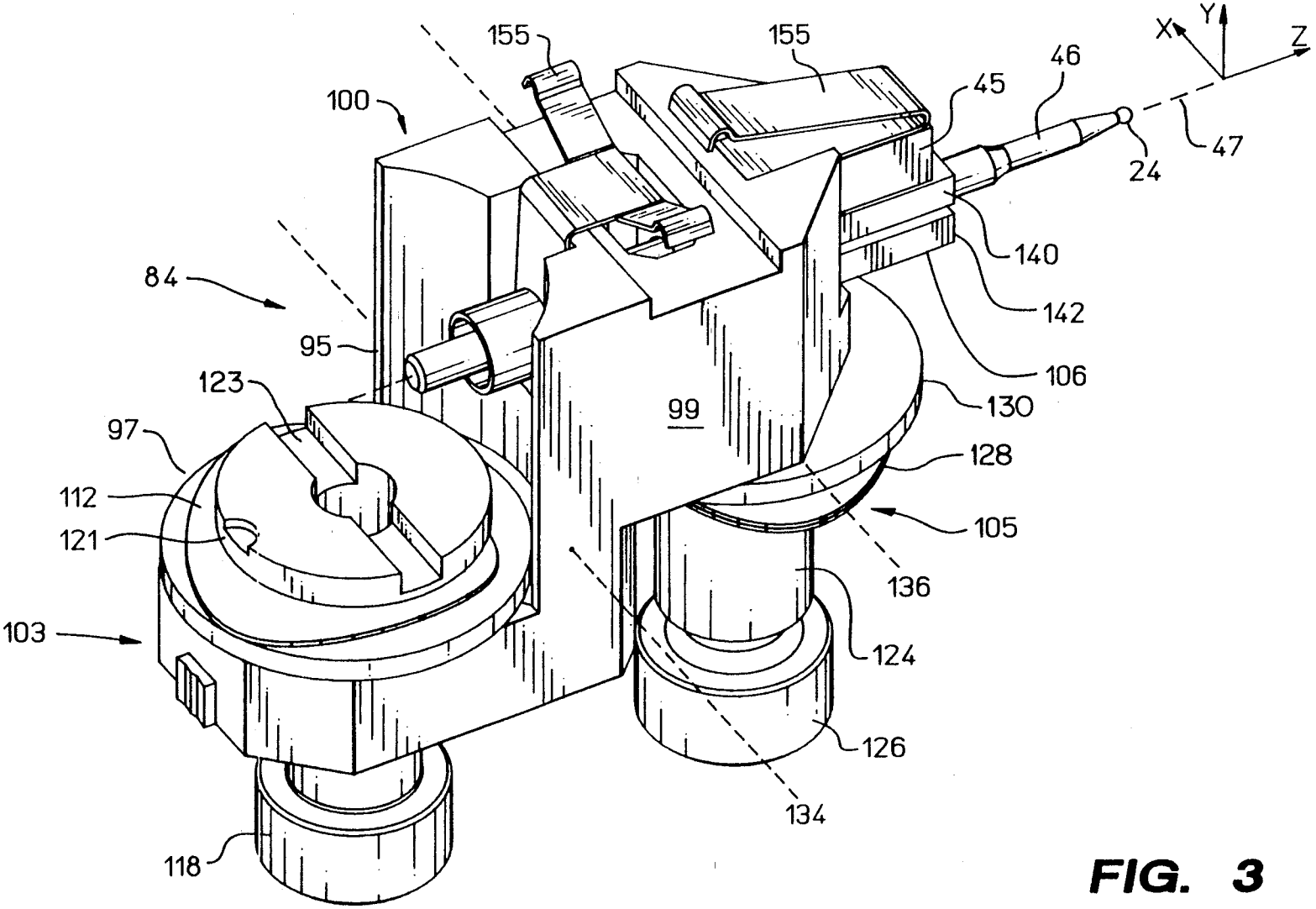
FIG. 3 is a perspective view of the positioning apparatus of this invention for positioning one sphere.

A typical sphere-positioning assembly 84 with its associated sphere rod 46 and YIG sphere 24 will now be described with particular reference to FIGS. 3 and 4. It is to be understood that each YIG sphere 24, 30, 36, and 40 is substantially identical, that each support rod 46, 48, 50, and 52 is substantially identical, and that each positioning assembly 84, 86, 88, and 90 is substantially identical.

Positioning assembly 84 includes support or housing 100, X-axis adjustment assembly 103, Y-axis adjustment assembly 105, assembly 107 for adjusting pole piece 64 and sphere rod collet 106. Sphere rod 46 passes through and is supported by housing 100. Sphere rod 46 is held tightly in position within housing 100 by sphere rod collet 106. Assembly 103 adjusts the position of sphere 24 in the X-axis direction by producing corresponding movement of housing 100, while assembly 105 adjusts the position of sphere 24 in the Y-axis direction by producing corresponding movement of housing 100, as will be described. Assembly 107 permits adjustment of pole piece 64, as described in the co-pending application entitled YIG-TUNED CIRCUIT WITH ROTATABLE MAGNETIC POLE PIECE, filed in the name of Hassan Tanbakuchi concurrently herewith. Typically, assembly 107 includes a blade 111 which engages a slot (not shown) in pole piece 64 for rotation of pole piece 64. Movement of sphere rod 46 along its axis of rotation 47, which extends from its proximal end to its distal end and which is generally aligned with the Z-axis, produces movement of sphere 24 in the Z-axis direction. Rotation of sphere rod 46 about its axis of rotation produces rotation of sphere 24, so that the crystalline axis of sphere 24 has a desired orientation with respect to the external DC magnetic field.

Housing 100 includes a rear section 97 and a front section 99 which is offset vertically with respect to section 97 to lie substantially above section 97. A vertical wall 95 joins section 97 to section 99. Rod 46 and collet 106 extend through section 99. Assembly 103 is associated with section 97, while assembly 105 is associated with section 99. It is to be understood, however, that housing 100 may have other geometries for other applications in other circuits.

Housing 100 typically is a relatively rigid structure, particularly in the Z-axis direction, and has low creep rates, high mechanical strength, and is threadable. Housing 100 should be thermally and electrically insulative to provide thermal isolation for collet 106 and the heater chip 45. The heater chip self-regulates to 105° C., keeping the YIG sphere temperature constant. Housing 100 also provides electrical insulation for the heater chip bias voltages which connect through spring clips 155 to a bias board. Preferably, housing 100 is formed of a plastic, injection-molded material, such as a polyamide under the mark TORLON.

Sphere rod collet 106 extends entirely through a corresponding hole formed in section 99 of housing 100. Collet 106 includes two spaced fingers 140 and 142 facing the distal end of rod 46. Fingers 140 and 142 are formed to have a precise spacing therebetween so that a tight frictional force is maintained on sphere rod 46. Typically, fingers 140 and 142 are heat treated to be spaced less than the diameter of rod 46. However, this frictional force can be overcome by the application of a predetermined amount of force to the proximal end of rod 46 for rotational and Z-axis movement thereof. A preferred composition for collet 106 is a beryllium copper alloy. Typically, collet 106 is held in housing 100 by epoxy encapsulation. A notch 144 is provided for electrical connection to the heater chip 45.

X-axis adjustment assembly 103 and Y-axis adjustment assembly 105 will now be described with particular reference to FIG. 4. Assembly 103 includes a cam 112 having an upper eccentric portion 113, an adjustment shaft or screw 118, and a spring 116. As can be seen from FIG. 4, upper portion 113 of cam 112 passes through a slot 73 in section 97 of housing 100 which is slightly enlarged to accommodate movement thereof. The upper portion 113 of cam 112 is enlarged and is eccentrically positioned with respect to the lower portion 115 of cam 112 which is circular in cross-sectional shape and passes through a precision hole in base plate 110 in which it pivots. Lower portion 115 of cam 112 mates with cam adjusting shaft or screw 118 which rotates about the same centrally-disposed axis as lower portion 115 of cam 112. Preferably, the cam adjusting screw 118 is torqued into lower portion 115 until the two are tightly jammed together. Upper portion 113 extends through housing 100 and includes an upper flange 120, the lower surface of which is spaced from an upper surface 117 of section 97. Spring 116, typically a crescent spring, is positioned between a washer 119 disposed on upper surface 117 and the lower surface of flange 120 to bias flange 120 away from upper surface 117. Spring 116 thereby clamps the lower surface of section 97 tightly against the upper surface of base plate 110 to hold housing 100 securely in place. Washer 119 provides a bearing surface for evenly distributing the force of spring 116 over upper surface 117, and for accommodating sliding motion caused by pivoting of housing 100, as described hereinafter. Flange 120 is provided with a notch 121 for positioning thereof within slot 118, and a slot 123 to facilitate mounting thereof within the assembly.

Assembly 105 includes a protrusion 124, an adjustment screw 126, and a spring, typically two crescent springs nestted together, 128. Protrusion 124 typically is cylindrical in shape and extends from section 99 of housing 100 into a precision bore in base plate 110. Protrusion 124 is positioned at the forward end of section 99 between assembly 103 and sphere 24. Screw 126, for example, a standard M2 cap head screw, is screwed into threads molded into the lower end of protrusion 124. Spring 128 is captured between washer 130, which bears against a lower surface 131 of section 99 of housing 100, and lip 132 formed on an upper surface of base plate 110 to bias housing 100 upwardly to seat screw 126 against the lower surface of base plate 110. Washer 130, which may be, for example, a standard M3 flat washer, evenly distributes the load generated by spring 128 over the lower surface of the housing.

In operation, if it is desired to adjust the position of sphere 24 in an X-axis direction, which may be, for example in a horizontal plane, screw 118 is rotated about a central axis of rotation. Rotation of screw 118 causes a corresponding rotation of lower portion 115 of cam 112, producing pivoting of upper portion 113 about its eccentric axis of rotation. Portion 113 bears against the sides of slot 73, which causes housing 100 to pivot about cylindrical protrusion 124. Pivoting of housing 100 produces a corresponding movement of sphere 24 along the X-axis, or in a horizontal direction.

Movement of sphere 24 along the Y-axis, or in a vertical direction, is produced by rotation and associated advancement or retraction of screw 126. When rotated in one direction, screw 126 urges section 99 of housing 100 upwardly, while when rotated in the opposite direction, screw 126 draws section 99 of housing 100 downwardly, producing corresponding movement of sphere 24, along the Y-axis. Spring 128 helps overcome any friction between protrusion 124 and the bore in which it sits in base plate 110. Typically, when the housing is configured as shown, rear section 97 remains fixed in the vertical direction, while only the front section 99 moves in a vertical or a Y-axis direction. In such a configuration, typically housing 100 flexes or bends in two less rigid locations to accommodate the vertical motion of the front section 99 with respect to rear section 97. These points of flexure or bending are shown as axes 134 and 136. (See FIG. 3). Axis 134 extends through wall 95 while axis 136 extends through a forward portion of section 99 above protrusion 124. Both axes 134 and 136 extend through housing 100 generally parallel to the X-axis, or horizontally. The amount of movement produced by either of these adjustments is extremely small, and thus very little flexing about axes 134 and 136 is required. Preferably, to move sphere 24 upwardly, screw 126 is rotated in a counterclockwise direction as shown from the bottom of baseplate 110 in FIG. 4, while to move the sphere downwardly, screw 126 is rotated in a clockwise direction as seen from the bottom of base plate 110, although the threads could be reversed in direction, if desired.

The rigidity of housing 100 must be carefully calculated to maintain a careful balance between its rigidity, the spring forces, and frictional forces so that the vertical (Y-axis) translation is maintained independent of the horizontal (X-axis) translation. During vertical translation, as screw 126 is rotated, frictional forces are generated between screw 126 and the threads molded into the lower end of protrusion 124. This frictional force creates a torque about the front pivot point of the housing, or about protrusion 124. This torque is resisted by upper portion 113 of cam 112 residing in slot 73. If this torque that is generated is sufficient to flex the housing, an undesired horizontal translation of the sphere could occur. If the torsional rigidity of the housing were increased, the stiffness of housing 100 to bending required for vertical translation would also be increased. This increased stiffness would require more spring force on screw 126, which would generate more frictional forces. The increased frictional forces would result in more housing deflection which would increase the error, rather than improve it. This particular housing design optimizes this balance between housing rigidity, spring force, and frictional forces and keeps the vertical translation independent of the horizontal translation.

During horizontal or X-axis sphere adjustment, the sphere actually tracks along a constant 11 degree slope with respect to true horizontal. Also, during this horizontal adjustment, housing 100 rotates about protrusion 124. Since screw 126 remains stationary with respect to base plate 110, this rotation produces a small vertical motion proportional to the pitch of the screw threads. It has been determined that this vertical motion amounts to about 12 percent of the horizontal adjustment of the sphere. This small amount of vertical motion has been found not to be important, since the effect is constant.

Figure 5:
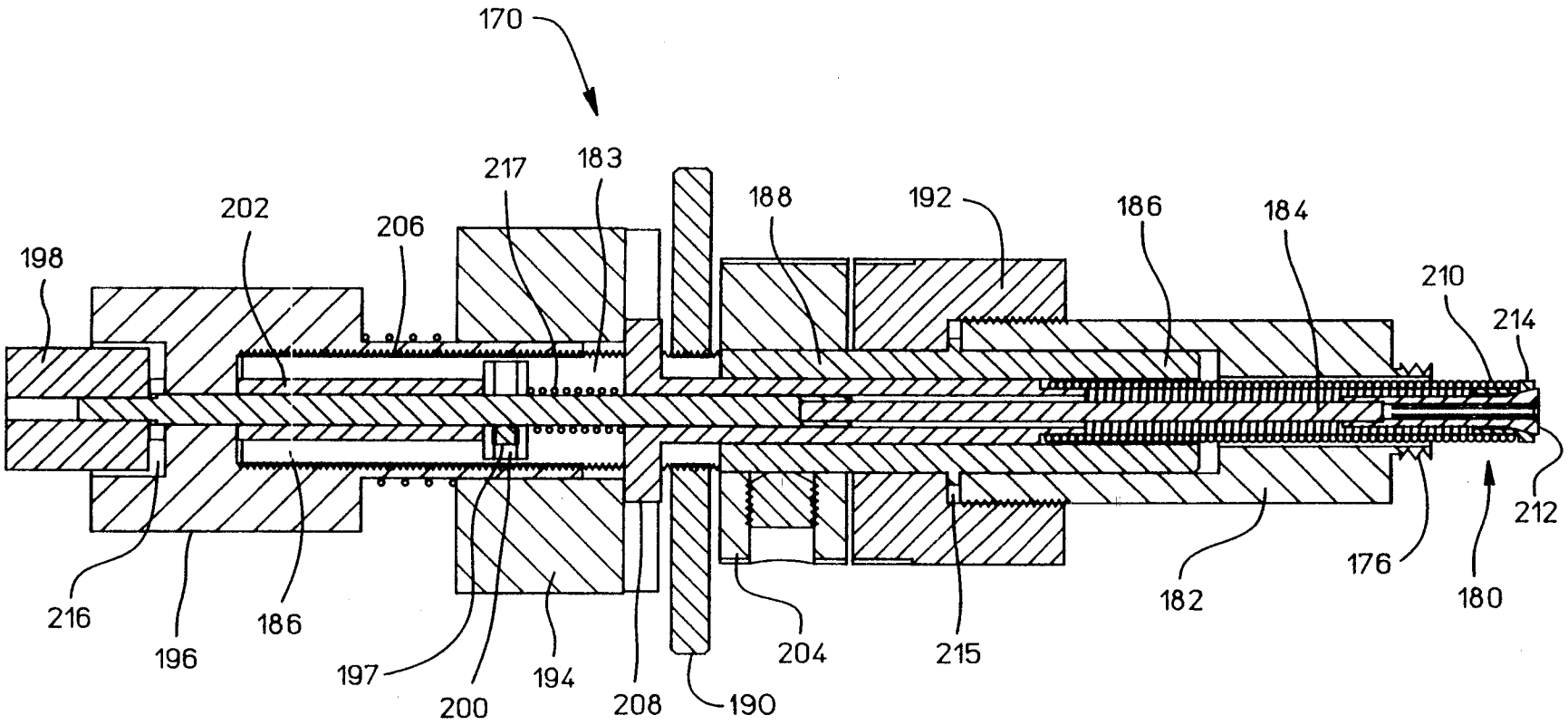
FIG. 5 is a cross-sectional side view of the external tooling for positioning of the sphere rod.
Figure 6:
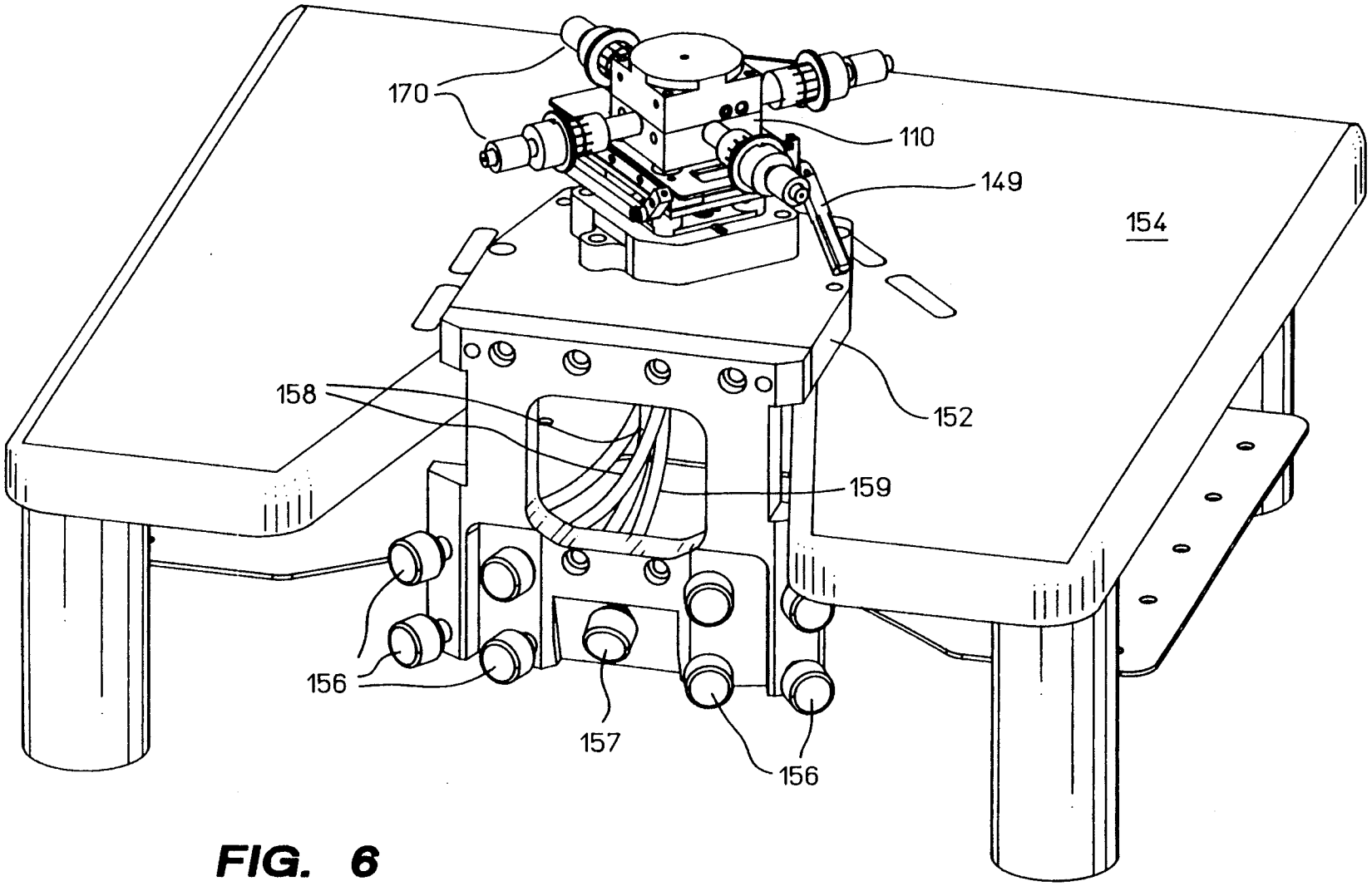
FIG. 6 is a perspective view of the apparatus of this invention with the external tooling attached for tuning thereof under test conditions.

The external test tooling utilized in conjunction with each resonator will now be described with reference to FIGS. 4–8. With particular reference to FIG. 6, typically, during the tuning process, base plate 110 containing the YIG-tuned resonator filter and mixer is mounted in a conventional manner onto a testing assembly 152 which in turn is mounted onto a stable working surface or table 154. Each screw 118 and 126 associated with each positioning assembly 84, 86, 88, and 90 is independently coupled to an associated knob 156 in test assembly 152 by an associated flexible shaft 158. Also, assembly 107 is coupled to an associated knob 157 by an associated flexible shaft 159.

Each shaft 158 and 159 is substantially identical, and is sufficiently flexible to be bent by up to about 90 degrees, but is torsionally rigid. Rotation of a knob 156 or 157 provides a torque to its associated shaft 158 or 159 which is fully transmitted along its length to an associated screw 118 or 126 or assembly 107 secured to the other end. It is preferred that the percentage of torque transmission be as high as possible, to ensure accuracy and responsiveness in the adjustment of the position of the spheres along the X and Y axes. While any such shaft which meets these requirements would be suitable, a typical shaft is a wound wire shaft coated with a plastic material. One example may be a flexible shaft purchased from Stock Drive Products in New Hyde Park, N.Y. under product designation 7C1308533. A preferred shaft has an outside diameter of 0.15 inch and is about 8 inches in length.

Figure 4:
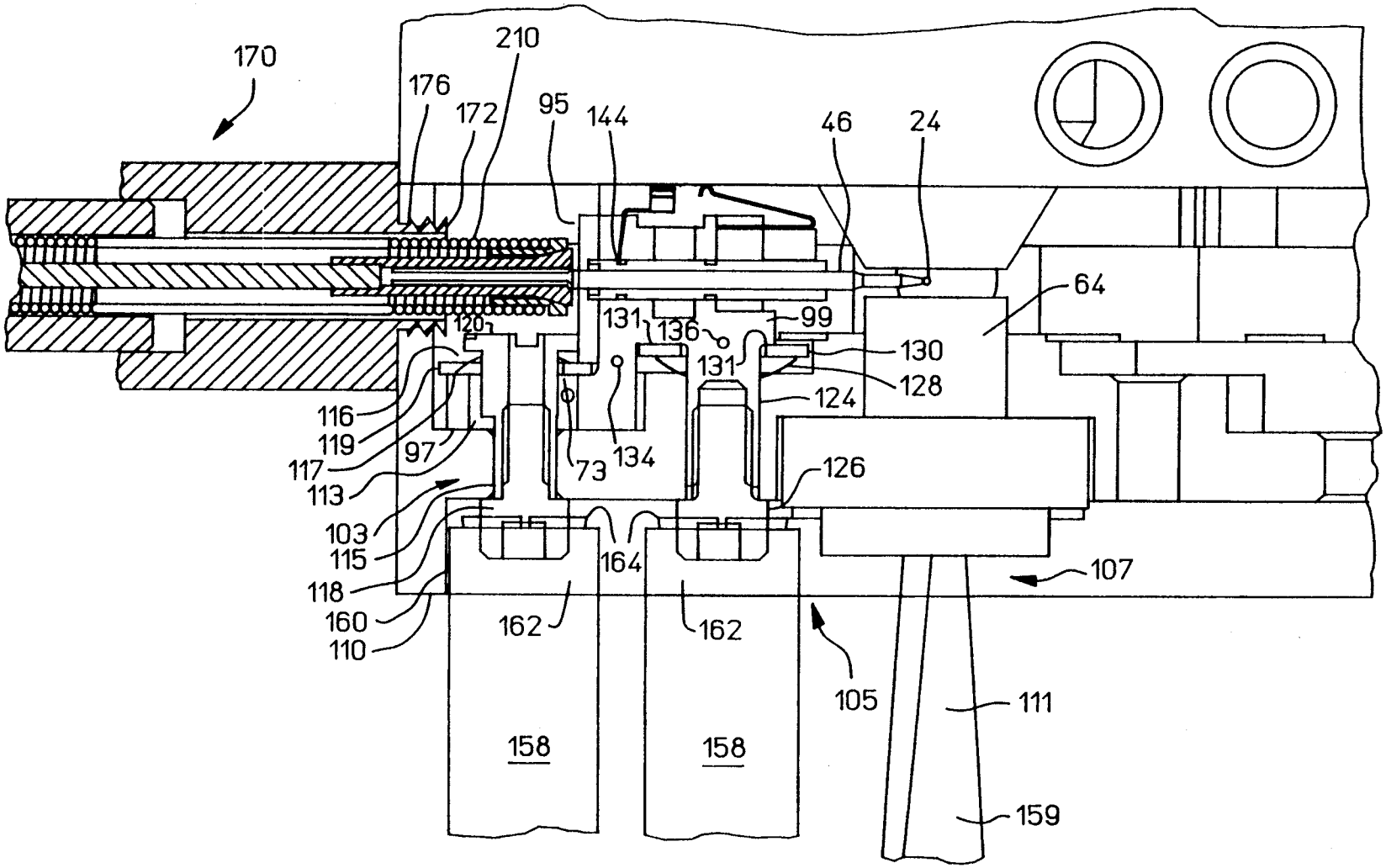
FIG. 4 is a partially cutaway, partial cross-sectional side view of the apparatus of FIG. 3, showing the attachment of the external tooling.

A preferred connection between shaft 158 and an associated screw 118 or 126 is shown in FIG. 4. The connection is a chuck arrangement disposed on the end of shaft 158 and includes a splined collet 160 and an associated outer sleeve 162 on shaft 158. Collet 160 typically has four fingers 164, each of which has a thickness which tapers to become thinner in a direction away from screw 118 or 126. As sleeve 162 is advanced toward the collet or toward associated screw 118 or 126, fingers 164 are urged inwardly by their taper toward the outer circumference of the head of screw 118 or screw 126 to tightly grasp it. Similarly, shaft 158 can be removed by retracting sleeve 162, allowing fingers 164 to move outwardly and release their grip on the outer circumference of the head of screw 118 or 126. Sleeve 162 is spring loaded to bias it upwardly to urge fingers 164 inwardly to grasp screws 118 and 126. Sleeves 162 typically are actuated by lever 149 (FIG. 6) which either retracts sleeves 162, or allows them to move upwardly. Preferably, lever 149 controls all sleeves 162 simultaneously. The opposite end of shaft 158 is directly connected to an associated knob 156. Rotation of knob 156 then produces rotation of shaft 158 which produces corresponding rotation of associated screw 118 or 126 to produce the desired effect.

The structure of knob 156 will now be described in greater detail with particular reference to FIGS. 7 and 8. Each knob 156 contains a hard stop to prevent sphere-to-loop crashing. Knob 157 contains no such hard stop. The location of the stop, or the permitted angular range of motion of the knob depends upon the sphere size and the geometry of the associated coupling loops. The stops are configured for each knob depending upon the maximum sphere translation required for that particular design.

Figure 7:
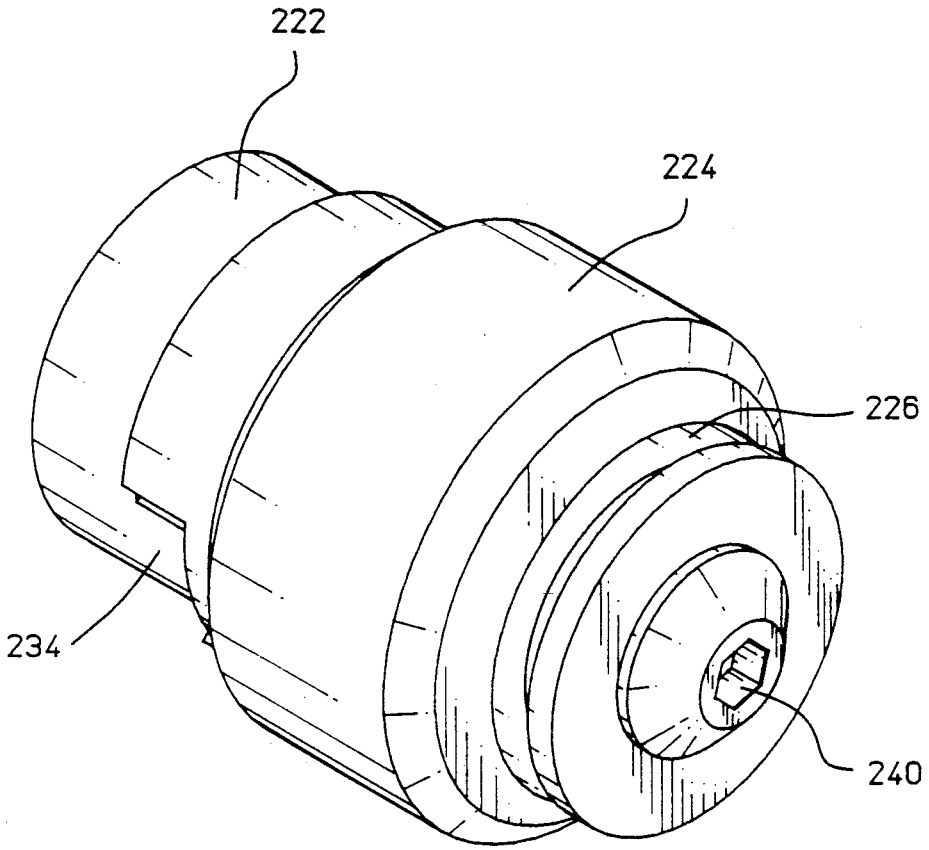
FIG. 7 is a perspective view of a typical knob of FIG. 6.
Figure 8:
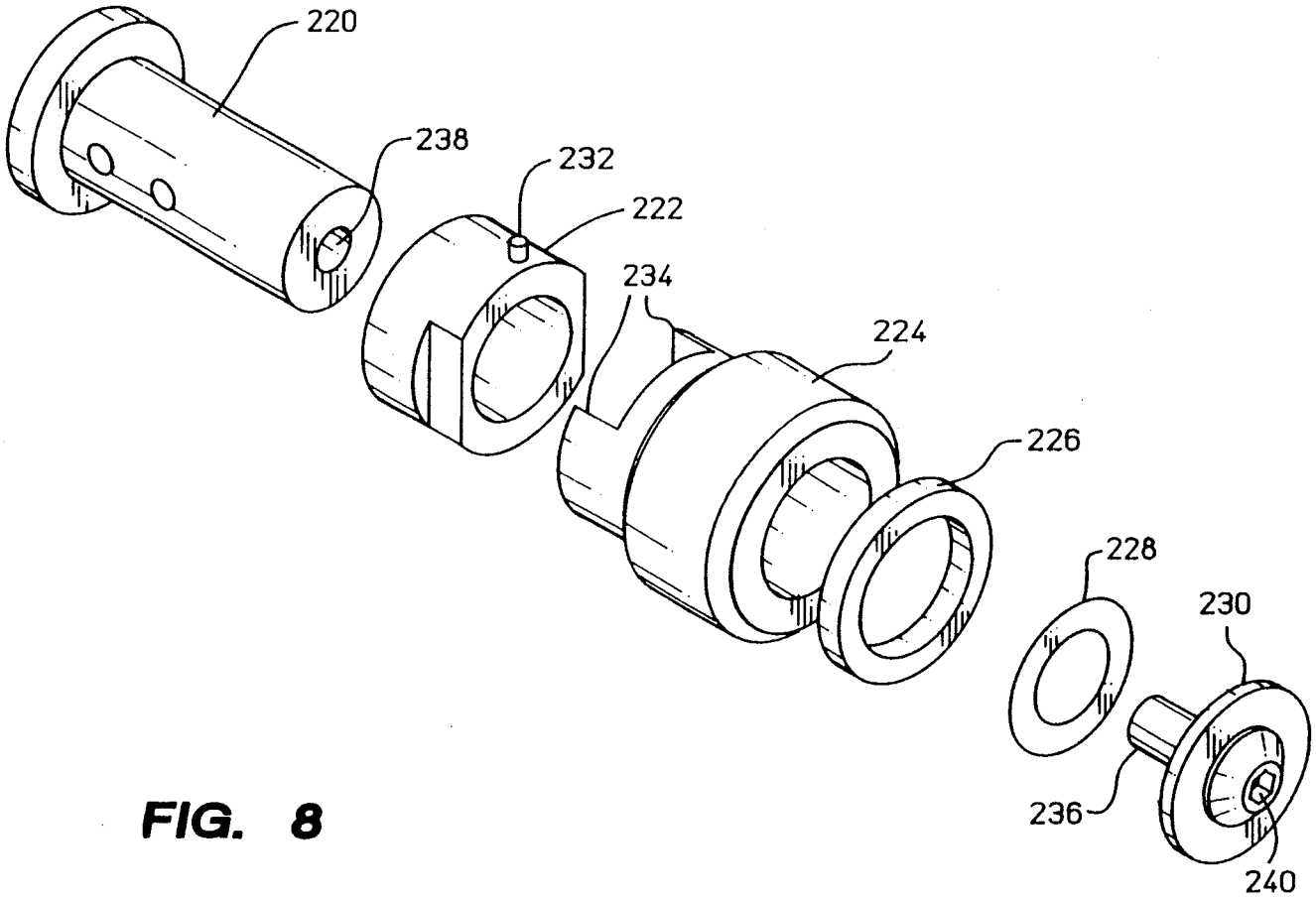
FIG. 8 is an exploded view of the knob of FIG. 7.

FIG. 7 shows a view of an assembled knob, while FIG. 8 is an exploded view of the same knob. As can be seen, each knob 156 includes a shaft mount 220, stop 222 having a pin 232, a portion 224 adapted to be grasped, a washer 226, a deformable O-ring 228 and an outer portion 230. When assembled, shaft 236 of portion 230 resides within hole 238 of mount 220 and is non-movably secured thereto. Mount 220, in turn, is directly secured to an end of shaft 158. Stop 222 is directly and non-movably mounted to testing assembly 152, and portion 224 rotates about shaft 236 and with respect to stop 222. Pin 232 is designed to engage shoulders 234 of portion 224 to limit rotation of portion 224, and thus of mount 220 and shaft 158, to the rotational angle subtended by shoulders 234. Portion 224 is coupled to mount 220, and thus shaft 158, only by the frictional engagement of portion 230 with portion 224 through washer 226 and O-ring 228.

In operation, portion 224 is grasped manually and rotated to produce the desired angular rotation of its associated screw 118 or screw 126 by rotation of associated connecting shaft 158. Portion 224 can be rotated through an angle until pin 232 abuts either one of shoulders 234. At this point, if it is desired to rotate screw 118 or screw 126 additionally for continued adjustment, portion 230 may be independently rotated a small additional amount. Such additional rotation preferably can only be accomplished using a screwdriver, hex wrench, or the like which mates with a corresponding slot 240 in portion 230. Rotation of portion 230 does not produce any corresponding rotation of portion 224 because of the abutment of pin 232 against shoulder 234. However, further rotation occurs through deformation of O-ring 228. The exact amount of deformation permitted and thus the amount of permitted continued rotation of portion 23 is predetermined by selection of an appropriate O-ring 228 and by the amount of compression of O-ring 228 produced by portion 230 when portion 230 is secured to mount 220. The amount of additional rotation permitted depends on the sphere and on the particular design of the system. The amount of compression required for O-ring 228 to provide the additional rotation desired can be determined through trial and error.

The angle subtended by shoulders 234 varies from design to design and from sphere to sphere. After the design is firm, the amount of desired angular rotation for each knob 156 is determined based on the maximum sphere translation that is desired. Initially, the desired angle is determined with the magnet off while a user visually watches the sphere translate within the loops. Certain exemplary angles can be set forth with respect to the particular circuit shown in FIG. 1. For example, in one embodiment, for the knob 156 associated with screw 118, associated with sphere 24, the permitted angular rotation of knob 156 is about 60°. For spheres 30 and 36, the corresponding amount of angular rotation is about 90°. For sphere 40, the permitted amount of rotation is about 100°.

Sphere rod positioner 170 will now be described with particular reference to FIGS. 4 and 5. Each positioner 170 is substantially identical. The forward end of positioner 170 is sufficiently flexible to accommodate movement of housing 100 in the X-axis direction and in the Y-axis direction, while still maintaining a tight grip on rod 46. Sphere rod positioner 170 permits both rotation of rod 46, and movement of sphere 24 in the Z-axis direction, or in a direction generally parallel to the axis of rotation of rod 46. Positioner 170 is secured to the proximal end of rod 46. Access is gained to rod 46 through a threaded opening 172 (see FIG. 4) in base plate 110 which is normally sealed using a conventional screw, such as a brass screw (not shown). During testing, the screw is removed, and positioner 170 is threadably attached to opening 172. Upon completion of testing, positioner 170 is removed by unscrewing, and the screw is replaced.

In a preferred embodiment, positioner 170 includes mount adapter 182, shaft 184, collet 180, body 186, sleeve 188, release 190, nut 192, rotator 194, translator 96, nut 198, shaft lock 200, spacer 202, marker 204, and sleeve 206. The distal end of shaft 184 is secured to collet 180, and shaft 184 extends the entire length of positioner 170. Shaft 184 typically has a circular cross-sectional shape, although shaft 184 could have a non-circular cross-sectional shape, such as a rectangular configuration. Nut 198 is secured to the proximal end of shaft 184. Adaptor 192 contains threads 176 which mate with threads in hole 172 in base plate 110 which provides access to sphere rod 46. Collet 180 and shaft 184 extend into base plate 110 to grasp rod 46. Nut 192 is threadably mounted onto adaptor 182 and secures the remaining portions of positioner 170 to adaptor 182. Translator 196 is threadably mounted onto sleeve 206 and can be rotated for axial movement of shaft 184 and sphere rod 46 in a Z-direction. Shaft lock 200 prevents rotation of shaft 184, and thus sphere rod 46 during rotation of translator 196, and imparts axial force on shaft 184 resulting from axial movement of translator 196. Shaft lock 200 is secured to shaft 184, such as by a set screw (197). Shaft lock 200 also extends into and rides in an axial slot defined by fingers 183 of body 186. Flared portion 208 also includes a finger or the like (not shown) which extends into and rides axially in the axial slot.

Release 190 is threadably mounted onto body 186 and advances or retracts sleeve 188 for grasping or releasing of the proximal end of sphere rod 46, as will be described. Rotator 194 rotates shaft 184, and thus sphere rod 46 and its associated sphere without any axial translation thereof. Rotator 194 is rotatably mounted on the outside of translator 196 and is secured to flared portion 208 of sleeve 188. Compression spring 217 extends from lock 200 to portion 208 and bears on portion 208 to urge portion 208 to the right, as shown in FIG. 5, to transmit axial force to sleeve 188 and then to spring 210. Marker 204 indicates the angular position of shaft 184, and thus sphere rod 46 and its associated sphere 24.

Collet 180 is adapted to grasp the proximal end of sphere rod 46. Collet 180 includes a plurality, typically four, fingers 212, outer sleeve 214, and extension spring 210. Fingers 212 are directly secured to the end of shaft 184. Fingers 212 are biased in an open position, providing an opening therebetween for acceptance of the proximal end of sphere rod 46. Fingers 212 typically are formed of a heat-treated metal, such as beryllium copper. Spring 210, which extends from sleeve 188 to sleeve 214, urges sleeve 214 toward the distal end of collet 180 so that it rides up on the outer surfaces of fingers 212. These outer surfaces of fingers 212 are angled such that as sleeve 214 is moved toward the right, as shown in FIG. 4, fingers 212 are urged radially inwardly. Fingers 212 are thus forced inwardly to tightly grasp the proximal end of sphere rod 46. Both shaft 184 and spring 210 are formed of a flexible material to permit positioner 170 to accommodate movement of sphere rod 46 in the X or Y-direction without causing movement of rod 46 in the Z-direction. While shaft 184 is flexible, it is torsionally very rigid. One example is a wound wire shaft known as a flexible shaft. This product can be purchased from, for example, Stock Drive Products in New Hyde Park, N.Y. under Product No. 7C1208333. A typical shaft 184 has a diameter of approximately 0.098 inch.

The operation and use of positioner 170 will now be described with particular reference to FIG. 5. Initially, the screw is removed from opening 172 (FIG. 4). Adaptor 182 is removed from positioner 170, and threads 176 are threaded into opening 172. Once adaptor 182 has been mounted onto base plate 110, the remaining portions of positioner 170 are secured in place as a unit. Adaptor 192 is rotated until stop 215 is engaged to axially secure together the various components in their desired relationship. Shaft 184 and associated sleeve 188 and body 186 are configured such that when adaptor 192 is tightened to its desired position, the proximal end of sphere rod 46 resides within the cylindrical space defined by the distal ends of fingers 212. Release 190 is rotated, such as in a clockwise direction in FIG. 5, so that release 190 advances axially toward collet 180, or from left to right in FIG. 5. This axial advancement of release 190 permits spring 217 to axially advance portion 208 and thus sleeve 188 from left to right in FIG. 5 toward collet 180. As sleeve 188 is advanced toward collet 180, extension spring 210 is compressed and an axial pressure is exerted on sleeve 214 urging it toward the proximal end of sphere rod 46, or to the right, as shown in FIG. 5. This movement has the effect of pushing fingers 212 radially together to tightly grasp the proximal end of sphere rod 46.

If it is desired to rotate sphere rod 46, rotator 194 is manually rotated about the axis of shaft 184, which causes rotation of sleeve 188. Rotation of sleeve 188 produces cooperative rotation of body 186, shaft 184, collet 180, which is secured to shaft 184, and spring 210, without axial movement of collet 180. This rotation produces a nearly identical angular rotation of sphere rod 46 and thus of its associated sphere 24.

Axial movement of shaft 184, and thus movement of sphere rod 46 in a Z-direction is produced by rotation of translator 196. It is preferred that Z-axis translation not be accompanied by rotation of sphere rod 46, so that the previously set rotational alignment of the sphere 24 not be disturbed during translation. It is preferred that these two adjustments be independent of one another. Rotation of translator 196, such as in a clockwise direction, produces axial movement of translator 196 from left to right as shown in FIG. 5, causing translator 196 to axially bear on spacer 202 which is urged against shaft lock 200. Washer 216 permits rotational movement of translator 196 independent of nut 198. Shaft lock 200 ensures that there is no rotation of shaft 184 during this operation. Shaft lock 200 transfers this axial movement of translator 196 to shaft 184 against the force of spring 217. Shaft 184 slides axially from left to right as shown in FIG. 5 independently of main body 186 to urge collet 180 to the right as shown in FIG. 5. Shaft lock 200 rides axially in slot 183 of body 186 to permit such movement. Such axial movement is transferred to the sphere rod which then produces an identical amount of Z-axis movement to its associated sphere 24. Conversely, when translator 196 is rotated in an opposite direction, typically a counterclockwise direction in FIG. 5, axial translation in a direction from right to left, as shown in FIG. 5, is produced by the threads. Such axial movement urges nut 198 from right to left as shown in FIG. 5, and permits spring 217 to urge lock 200 from right to left. This axial movement is transferred to shaft 184 which is withdrawn from the base plate, causing sphere rod 46 and thus its associated sphere to move from right to left an identical distance in the Z-axis direction, as shown in FIG. 5. No rotational movement is imparted to shaft 184.

Removal of positioner 170 is accomplished by reversing the mounting steps. Initially, release 190 is rotated in an opposite direction, typically a counterclockwise direction, causing portion 208 and thus sleeve 188 to move from right to left as shown in FIG. 5, to compress spring 217. This motion releases pressure on spring 210, and permits sleeve 214 to move from right to left, as shown in FIG. 5. This movement allows the natural bias of fingers 212 to move fingers 212 radially outwardly into their open position, and to urge sleeve 214 axially from right to left (FIG. 5) along the outer slope thereof. Thereafter, nut 192 is unscrewed from adaptor 182, and shaft 184, collet 180, and sleeve 188 and all other associated parts are withdrawn from adaptor 182. Finally, adaptor 182 is unscrewed from the chassis, and the screw (not shown) is returned to opening 172.

When it is desired to tune a circuit in accordance with this invention, resonators 10, 12, 14, and 16 are tuned sequentially in that order. The tuning is accomplished without any visual observation of the position of the spheres by observing a bandpass filter signal while the unit is under test. It is desired to obtain a good filter shape, and to eliminate the ripples in the pass band.

This particular invention has many benefits over the prior art. With the provision of the sphere translation stops on knobs 156, there is little or no danger of harming the microcircuit during final test. There is no requirement for additional clamping or potting to maintain the adjustments, once they have been made. If it is desired to retune the circuit, this can be done simply and easily, at any time. Retuning is also repeatable, since none of the magnetic structure or adjustments have been disturbed in the interim. Retuning is also facilitated by the fact that the sphere adjustment screws are readily accessible from beneath the base plate of the housing, greatly simplifying the interface for test tooling. The housing assembly, should it be required, can be inserted and removed without disturbing any other part of the microcircuit. As a consequence of the foregoing simple mechanical design, the result is a high performance, low cost YIG microcircuit.

In view of the above description, it is likely that modifications and improvements will occur to those skilled in the art which are within the scope of this invention. The above description is intended to be exemplary only, the scope of the invention being defined by the following claims and their equivalents.

What is claimed is:

1. A tunable ferrimagnetic resonator circuit comprising:

means for producing a magnetic field;

a plurality of ferrimagnetic resonators connected in series and located in said magnetic field, each of said resonators including a ferrimagnetic sphere and associated input and output coupling loops; and means associated with each of said resonators for adjusting the location of said ferrimagnetic sphere with respect to its associated input and output coupling loops and said magnetic field, said adjusting means comprising:

an elongated support member having a distal end and a proximal end, said ferrimagnetic sphere being disposed on said distal end of said support member, said support member having an axis of rotation generally parallel to its direction of elongation, said support member being non-magnetic and non-electrically conductive;

means for supporting said support member at a location intermediate said distal and proximal ends thereof, said support means permitting selective rotation of said support member about said axis of rotation and movement of said support member in a first direction generally parallel to said axis of rotation thereof upon the selective application of a respective rotational force and an axial force to said proximal end of said support member;

first means for producing movement of said support means for translating said sphere in a second direction generally perpendicular to said first direction; and second means for producing movement of said support means for translating said sphere in a third direction generally perpendicular to said first direction and to said second direction.

2. A tunable ferrimagnetic resonator circuit as recited in claim 1 wherein said first producing means comprises means for pivoting said support means about a fixed axis.

3. A tunable ferrimagnetic resonator circuit as recited in claim 1 wherein said second producing means comprises means for bending said support means.

4. A tunable ferrimagnetic resonator circuit as recited in claim 1 further comprising a housing completely surrounding and enclosing said plurality of ferrimagnetic resonators and said adjusting means, wherein each of said rotating means, said moving means, said first producing means, and said second producing means each comprise separate, manually manipulatable means extending through a wall of said housing.

5. A tunable ferrimagnetic resonator circuit as recited in claim 1 wherein said first producing means comprises a rotatable eccentric cam for producing rotational motion of said support means about an axis generally parallel to said third direction.

6. A tunable ferrimagnetic resonator circuit as recited in claim 1 wherein said second producing means comprises a threaded shaft which can be selectively advanced and retracted to produce bending of said support means about an axis generally parallel to said second direction.

7. A tunable ferrimagnetic resonator circuit as recited in claim 4 wherein each of said first producing means and said second producing means includes manually rotatable means disposed externally of said housing.

8. A tunable ferrimagnetic resonator circuit as recited in claim 7 wherein said first and second producing means each comprise means for limiting rotational movement of said manually rotatable means.

9. A tunable ferrimagnetic resonator circuit as recited in claim 8 further comprising means for overriding said limiting means to allow a predetermined additional rotational movement.

10. A tunable ferrimagnetic resonator circuit as recited in claim 1 wherein said support means includes means for frictionally holding said support member in a desired position.

11. A method of tuning a tunable ferrimagnetic resonator circuit having a plurality of ferrimagnetic resonators disposed in a magnetic field, each of said resonators including a ferrimagnetic sphere mounted on a distal end of a support member which is supported by a housing intermediate a distal and proximal end of said support member, and associated input and output coupling loops, for each resonator, said method comprising the steps of:

rotating the support member about an axis extending from the proximal to the distal ends thereof to align the sphere in the magnetic field;

adjusting the position of the ferrimagnetic sphere with respect to its associated coupling loops by moving the support member with respect to the housing along the axis of rotation of the support member, pivoting the housing about a second axis which is generally perpendicular to the axis of rotation, and bending the housing about a third axis generally perpendicular to the axis of rotation and the second axis;

observing the signal produced during said adjusting and rotating steps; and performing additional rotating and adjusting steps in response to said observing step.

12. A tunable YIG resonator circuit for filtering RF signals comprising:

a housing;

means for producing a magnetic field;

a plurality of YIG resonators connected in series and located in said magnetic field, said YIG resonators being enclosed within said housing, each of said YIG resonators comprising:

a YIG sphere;

input and output coupling loops associated with said YIG sphere;

a non-magnetic, non-electrically conductive, elongated rod having a distal end and a proximal end and an axis extending from said distal end to said proximal end, said sphere being disposed on said distal end thereof, said proximal end of said rod being adapted to receive means extending through a wall of said housing for selectively rotating said rod with respect to said supporting means and moving said rod in a direction parallel to said axis thereof;

means disposed between said distal and proximal ends of said rod for supporting said rod and holding said rod and said sphere in alignment;

second means extending through a wall of said housing and being manually manipulatable externally of said housing for moving said supporting means to produce movement of said sphere along a second axis generally perpendicular to said axis of said rod; and third means extending through said housing and being manually manipulatable externally of said housing for moving said supporting means to produce movement of said sphere along a third axis generally perpendicular to said axis of said rod and said second axis.

13. Apparatus for supporting and adjusting a ferrimagnetic sphere in a tunable ferrimagnetic resonator circuit, said apparatus comprising:

an elongated support member having a distal end and a proximal end, the ferrimagnetic sphere being disposed on said distal end of said support member, said support member having an axis of rotation generally parallel to its direction of elongation, said support member being non-magnetic and non-electrically conductive;

means for supporting said support member at a location intermediate said distal and proximal ends thereof;

means for rotating said support member about said axis of rotation, said rotating means having a manually manipulatable portion disposed externally of the resonator circuit;

means for moving said support member in a first direction generally parallel to said axis of rotation thereof, said moving means having a manually manipulatable portion disposed externally of the resonator circuit;

first means for producing movement of said support means for translating the sphere in a second direction generally perpendicular to said first direction;

second means for producing movement of said support means for translating the sphere in a third direction generally perpendicular to said first direction and to said second direction;

manually manipulatable means disposed externally of the resonator circuit and being connected to said first producing means and said second producing means for selectively actuating said first and second producing means; and means associated with said manually manipulatable means for limiting movement of said first and second producing means.

* * * * *